US008215414B2

(12) United States Patent
Tuomas

(10) Patent No.: US 8,215,414 B2
(45) Date of Patent: Jul. 10, 2012

(54) ROCK DRILLING METHOD AND ROCK DRILLING MACHINE

(75) Inventor: Göran Tuomas, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 229 days.

(21) Appl. No.: 12/311,650

(22) PCT Filed: Nov. 7, 2007

(86) PCT No.: PCT/SE2007/000987

§ 371 (c)(1),
(2), (4) Date: Apr. 7, 2009

(87) PCT Pub. No.: WO2008/060216

PCT Pub. Date: May 22, 2008

(65) Prior Publication Data

US 2010/0032177 A1 Feb. 11, 2010

(30) Foreign Application Priority Data

Nov. 16, 2006 (SE) ..... 0602436

(51) Int. Cl.
*E21B 1/28* (2006.01)

(52) U.S. Cl. ..... 173/1; 173/200; 173/210

(58) Field of Classification Search ..... 173/1, 200, 173/210

See application file for complete search history.

(56) References Cited

U.S. PATENT DOCUMENTS

| | | | | |
|---|---|---|---|---|
| 879,971 | A * | 2/1908 | Locke | 175/212 |
| 3,405,770 | A * | 10/1968 | Galle et al. | 175/56 |
| 3,662,843 | A * | 5/1972 | Wise | 173/131 |
| 4,039,033 | A | 8/1977 | Salmi | |
| 4,109,734 | A | 8/1978 | Montabert | |
| 4,165,788 | A | 8/1979 | Montabert | |
| 4,349,075 | A | 9/1982 | Henriksson | |
| 4,363,365 | A | 12/1982 | Nikolaev et al. | |

(Continued)

FOREIGN PATENT DOCUMENTS

EP 0856637 A1 8/1998

(Continued)

OTHER PUBLICATIONS

Patent Abstract of Japan -abstract & JP11033932 A (Furukawa Co Ltd), Feb. 9, 1999.

*Primary Examiner* — Brian D Nash
(74) *Attorney, Agent, or Firm* — Mark P. Stone

(57) ABSTRACT

A pulse drilling machine (1;1') for the generating of shock wave pulses in a tool direction (R) has an impulse piston (4;4') with a housing (2), and a device (8) for abruptly changing fluid pressure influencing the impulse piston to achieve a force resultant on the impulse piston in the tool direction to generate a shock wave pulse in a drill string (13; 13') which is connected to the machine, a first fluid chamber (14;3') inside the housing which in operation is arranged to exert a pressure in the tool direction on the impulse piston. The machine has a fluid flow channel (11; 18; 19), which includes a device for damping fluid flow flowing from the first fluid chamber through the fluid flow channel obtained when influencing the impulse piston (4; 4') in a direction opposite to the tool direction (R) by rock reflexes in the drill string during drilling.

36 Claims, 4 Drawing Sheets

U.S. PATENT DOCUMENTS

| | | | | |
|---|---|---|---|---|
| 4,624,325 | A | 11/1986 | Steiner | |
| 4,930,584 | A * | 6/1990 | Chaur Ching et al. | 173/200 |
| 4,993,504 | A * | 2/1991 | Rodert et al. | 175/135 |
| 5,002,136 | A | 3/1991 | Barthomeuf | |
| 5,056,606 | A | 10/1991 | Barthomeuf | |
| 7,013,996 | B2 * | 3/2006 | Keskiniva et al. | 175/135 |
| 2005/0139368 | A1 * | 6/2005 | Keskiniva et al. | 173/206 |
| 2006/0157259 | A1 * | 7/2006 | Keskiniva et al. | 173/1 |
| 2010/0288519 | A1 * | 11/2010 | Tuomas | 173/1 |

FOREIGN PATENT DOCUMENTS

| | | | |
|---|---|---|---|
| GB | 370749 | | 4/1932 |
| SE | 7614065 | | 6/1977 |
| SE | 8100961 | | 8/1982 |
| SE | 7607257 | | 12/1996 |
| WO | WO 99/47313 | A1 | 9/1999 |
| WO | WO 03/033873 | A1 | 4/2003 |
| WO | WO 2005/002802 | A1 | 1/2005 |
| WO | WO 2007/073275 | A1 | 6/2007 |

* cited by examiner

ROCK DRILLING METHOD AND ROCK DRILLING MACHINE

FIELD OF THE INVENTION

The invention concerns a pulse drilling machine for the generating of shock wave pulses. The invention also concerns a method for generating shock wave pulses. Further, the invention concerns a drilling rig.

BACKGROUND OF THE INVENTION

During rock drilling, shock wave pulses are generated in the form of pressure force pulses which are transferred from a shock wave producing device such as an impulse device through a drill string to a drill bit. Drill bit insert buttons are thereby pressed against the rock with high intensity and achieves crushing and forming of crevices in the meeting rock.

In conventional rock drilling machines, the shock wave pulses are generated by means of an impact piston, which strikes against a drill shank for the further transfer of the shock wave to the drill string.

The present invention, however, concerns another type of shock wave generating rock drilling machines, herein called pulse drilling machines. These machines work differently from the above mentioned machines that are equipped with an impact piston, namely in that a fluid pressure is brought to create a force which periodically acts against a piston adapter in the form of an impulse piston, which in turn is pressed against and transmits shock wave pulses to a drill string. The impulse piston, which is not to be confused for the impact piston in a conventional machine, has a small mass seen in this connection, which does not have any important effect on the function of the impulse machine. WO2004/073933 could be mentioned as an example of the background art.

AIM AND MOST IMPORTANT FEATURES OF THE INVENTION

It is an aim of the present invention to provide a device and a method as mentioned initially which are further developments and enhancements in respect of known pulse drilling machines and in particular gives the possibility of more efficient rock drilling.

These aims are obtained in respect of a device and a method as mentioned initially through the features of the characterizing parts of the independent patent claims.

Through the invention is provided a possibility of damping rock reflexes occurring during drilling, whereby a number of important advantages are achieved, such as possibility of drilling with an increased rock drilling efficiency. It is also achieved that the machine can be protected against the strain which occurs from reflected shock waves, which is expected to result in longer working life of a machine constructed according to the invention.

In a previously known impact drilling machine including an impact piston, the purpose of the so called damping piston is to transfer the feed force against the rock from the machine housing to the drill bushing further over the adapter, over the drill string to the drill bit for its contact against the rock. According to the background art, the damping piston is prestressed through a hydraulic/pneumatic spring, being comprised of a hydraulic fluid in a chamber which often is in connection with a hydraulic/pneumatic accumulator.

If the shock wave generated by the impact piston through the drill string is not matched to the rock impedance, reflexes are returned through the drill string. If the rock is hard compared to the shock wave force, mainly compressive reflexes are obtained, the amplitudes of which can be twice as great as that of the incident shock wave.

The pressure reflexes force the drill bushing and the damping piston in the direction from the drill string, whereby hydraulic oil is loaded into the accumulator. The pressure therein thereby pushes back the damping piston and the drill bushing to the initial position against a mechanical strop in machine housing. The flexibility of a connected accumulator provides a resilient function which protects the drilling machine against high strains and vibrations. This increases the working life of the drilling machine and allows greater power to be transferred.

In percussive piston devices there are thus used separate components in order to obtain the damping functions. This systems, however, have proved to operate badly during drilling with high frequencies (>200 Hz).

Through the present invention it's obtained that the impulse piston itself of a pulse drilling machine is used to provide a damping function. Hereby the need of separate components such as particular damping pistons is avoided. The advantages are on the one hand the possibility of obtaining a very rapid damping system, on the other hand reducing the number of moveable parts and components, which results in better economy.

By the fluid flow channel being connected to a pressure fluid accumulator, there are achieved enhanced possibility of damping fast processes.

By the first fluid chamber being a separate damping chamber which is arranged radially outside the impulse piston it is achieved that the damping piston and the associated hydraulic system can be dimension respectively be controlled in consideration only of the damping function without taking into account possible other functions.

By the fluid flow channel including a restriction, and in particular a throttling slot between the housing and the impulse piston, it is achieved that the energy being reflected is absorbed in an advantageous way.

By a supply channel for fluid being connected to the damping chamber for providing a leak flow, there is allowed a provision for cooling damped energy in the machine and thereby enhanced operating properties.

By the first fluid chamber being a chamber adjoining axially to the impulse piston, a simple and economic construction is obtained which allows the use of one chamber for plural functions. It is hereby preferred that the first fluid chamber is connected to a high pressure fluid source. In particular the first fluid chamber is either-permanently connected to the high pressure fluid source or intermittently connected to the high pressure fluid source.

By means for sensing the pressure in the first fluid chamber being arranged, the possibility is allowed to utilize signals in respect of sensed pressure, for drilling control.

By said means for abrupt change of fluid pressure affecting an impulse piston being controllable starting out from sensed pressure in the first fluid chamber, it is possible to control means for generating the shock wave pulses. This in particular in order to regulate the frequency of generation of shock wave pulses. This in order to regulate in the direction of reduction of the shock wave reflexes.

It is preferred that there are arranged means for regulating the fluid flow in the fluid flow channel and thereby the damping.

It is particularly advantageous to control the length of the shock wave pulse as a response to sensed shock wave reflex. This way the invention can be used in order such that the drilling parameters are adjusted in real time, to for example fluctuating hardness in rock to be drilled, in a manageable way.

Advantages of a device according to the invention corresponding to the above advantages in respect of the different device aspects are obtained in respect of corresponding method claims. Further features and advantages of the invention and its different aspects will be clear from the following detailed description.

BRIEF DESCRIPTION OF DRAWINGS

The invention will now be described in greater detail by way of embodiments and with reference to the annexed drawings, wherein.

DETAILED DESCRIPTION OF EMBODIMENTS

Figure 1:
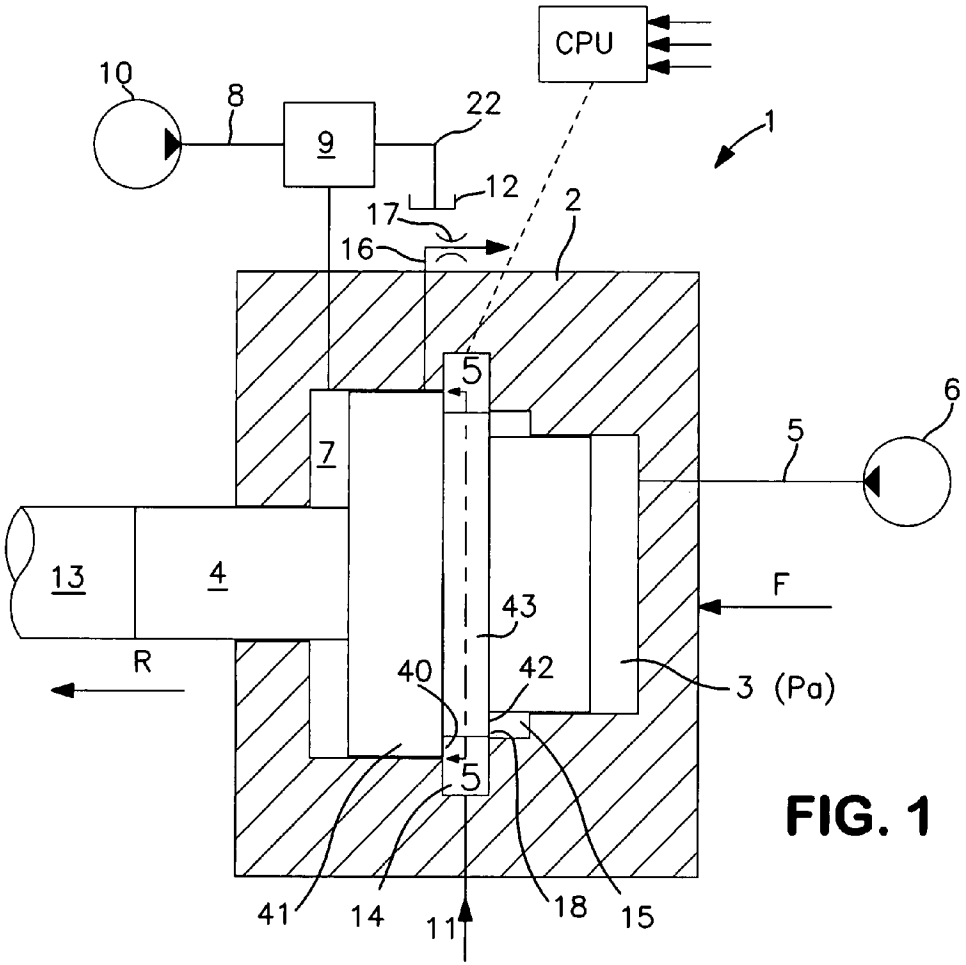
FIG. 1 diagrammatically shows a first embodiment of a pulse machine according to the invention in an axial section, FIG. 2 diagrammatically shows a second embodiment of a pulse machine according to the invention in an axial section.

With reference to FIG. 1 a pulse generator of a pulse drilling machine according to the invention is generally indicated with 1. In a housing 2 an impulse piston 4 is restrictedly moveable to and fro. The impulse piston contacts at a partition section against an upper portion, indicated with 13, of a drill string. Adjoining to the underside of the inside impulse piston 4 is arranged a counter force chamber 7 which is pressurised with counter pressure Pm for action with a counter force on the impulse piston in a direction opposite to a tool direction R.

The pressure in the chamber 7 is controlled in that a valve 9 periodically transmits an initial pressure from a pump 10 over a pressure conduit 8 to this chamber 7. From that valve also leads a tank conduit 18 to tank 12 for periodic relieve of the first fluid chamber 7.

Adjoining to the other side of the impulse piston 4 is arranged a pressurizing chamber 3 which is capable of being pressurized with pressure Pa for generating a force acting in the tool direction R.

In an embodiment of the invention, the pressure in the chamber 3 is virtually constant, maintained by a pressure pump 6 over a pressure conduit 5 and leveled by a (not shown) accumulator.

Onto the housing of the impulse machine 1 is further acting, as is conventional, a feed force F in said tool direction R.

By the pressure in the counter force chamber 7 being abruptly relieved by switching the valve 9, the impulse piston through the pressure in the pressurizing chamber 3 receives a forward movement in said direction R, which in turn results in that a shock wave is induced into the drill string 13 for transfer to a not shown drill bit.

When the impulse thus is completed, the counter force chamber 7 is again pressurized by resetting the valve 9 for restoring conduit contact with the pump 10, whereupon the impulse piston 4 is again displaced a distance (to the right in the Figure; in the direction opposite to the tool direction R), whereupon the machine is ready for the next pulse cycle.

In the shown embodiment the impulse piston 4 is constructed with a first damping piston portion 41, which is comprised of a ring-shaped, radial extension of the impulse piston 4. The first damping piston portion 41 co-operates with a first fluid chamber/damping chamber 14, which is in turn comprised of a ring-shaped chamber being positioned radially outside of the impulse piston 4, through a first, ring-shaped, damping piston surface 40 directed opposite to the tool direction R, which is influenced in the tool direction by the pressure in the first fluid chamber 14. The damping function of the device according to FIG. 1 is maintained with the aid of a hydraulic damping flow which is supplied to the first fluid chamber 14 through a fluid flow channel in the form of a first damping channel 11. The hydraulic damping fluid is evacuated through a second damping channel 16 in advanced positions of the impulse piston, when the mouth of the second damping channel 16 is uncovered by the first damping piston portion. When, however, the impulse piston is in a position according to the Figure, wherein the mouth of the second damping channel 16 in the housing is covered, there is created a pressure inside the first fluid chamber 14 which generates a force on the impulse piston over the first damping piston surface 40 in the tool direction R. This force can be set greater than the feed force in order to give the possibility of positioning of the housing position in respect of the drill string. Equilibrium is obtained when the force generated by the pressure in the first fluid chamber 14 corresponds to the feed force, which can be named "a floating position". A restriction 17 can be applied in the second damping channel 16 for ensuring a chosen smallest force generated in the first fluid chamber 14 acting on the impulse piston.

The first damping channel 11 can also be provided with an accumulator (not shown) in order to allow damping of fast shock wave reflexes and fast displacements of the impulse piston caused thereby. It is also totally possible to position a throttling, possibly in combination with a pressure reduction valve (not shown), in the first damping channel 11 because of reasons which will be explained below.

In operation and at reception of rock flexes through the drill string, a reflected (compressive) shock wave will drive the impulse piston in the direction opposite to the tool direction R. Hereby the impulse piston will be counteracted by the forces generated by the pressures in the pressurizing chamber 3 and in the first fluid chamber 14, respectively. In particular the impulse piston will be counteracted by a balanced damping force generated in the first fluid chamber 14. When a throttling is present in the first damping channel, there is obtained an advantageous energy absorption by flow flowing through the restriction and thereby energy reception of the reflex movement of the impulse piston.

The embodiment of FIG. 1 also exhibits an optional separate second fluid chamber/damping chamber 15, which co-operates with a likewise optional second damping piston portion 43, which is also comprised of a ring-shaped, radial extension of the impulse piston 4. The second damping piston portion 43 co-operates with the second fluid chamber 15, which in turn is comprised of a ring-shaped chamber positioned radially outside the impulse piston 4, through a second, ring-shaped damping piston surface 42 directed opposite to the tool direction R, which is actuated in the tool direction by the pressure in the second fluid chamber 15. In this variant, and in a position according to FIG. 1, the second fluid chamber 15 will be evacuated to the first fluid chamber 14 over a fluid flow channel which is established in this position in the form of a throttling slit 18 between the impulse piston and the housing. Pressure builds up in the second fluid chamber 15 results on the one hand in a damping force, on the other hand in energy absorption by flow flowing through the throttling slit and thereby energy reception of the reflex movement of the impulse piston.

Figure 5:
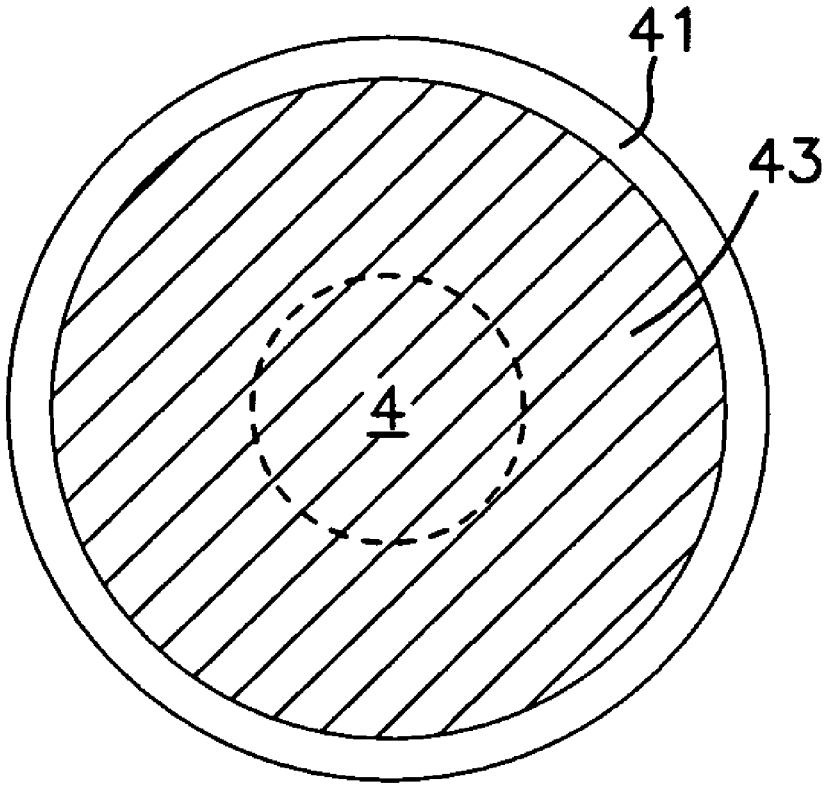
FIG. 5 shows a cross-sectional view taken along directional arrows 5-5 of FIG. 1.

FIG. 5 illustrates the first damping piston portion 41 and the second damping piston portion 43, both of which are radial extensions of the impulse piston 4.

When the impulse piston regains a displacement in the tool direction, fluid will again flow to the second fluid chamber 15 through the same throttling slit 18. Possibly a supply conduit with a one way valve can be connected to the second fluid chamber (not shown).

A CPU can be arranged to detect the pressure in the first fluid chamber 14 in order to, starting out therefrom, determine the size and character of the rock reflexes and from that position control a machine parameter such as for example the pulse frequency, the feed force, the throttling, the damping flow, the damping pressure, the process of relieving the pressure in the counterforce chamber and at occurrences the pressure build up in the pressurizing chamber in order to control the drilling in the direction of enhanced efficiency or any other criterion for the drilling.

The embodiment shown in FIG. 1 can as a variant be operated such that a second force acting in the tool direction on the impulse piston du ring a complete impulse cycle is set greater that a first force on the impulse piston in a direction opposite to said tool direction. The first force is generated through a first fluid pressure in the counter force chamber 7. The second force in the tool direction can be generated by a fluid pressure in the pressurizing chamber 3 or alternatively in that on this side of the impulse piston 4 there is acting a force generated through elastic members such as springs of metal, rubber, synthetic material or through a metal rod etc. The feed force F together with the first force is thereby periodically brought to exceed the second force. The sum of the feed force F and said first force acting on the impulse machine 1 is thus periodically, that is under a part of the impulse cycle, brought to exceed said second force in order to achieve displacement of the impulse piston 4 in a direction opposite to the tool direction relative the housing 2. Hereby the feed force together with the first force is thus utilized to provide displacement of the impulse piston in the direction opposite to the tool direction. The subsequent relieve of the first fluid pressure thereupon results in inducing a shock wave pulse in a drill string or the like. In this variant, the damping system with the first fluid chamber and the second fluid chamber can be utilized for obtaining a more stabilised defined floating position of the impulse machine. This is achieved in such a way that, in operation, pressing-in with the aid of the feed force is conducted into a position where the extended portion of the impulse piston establishes a damping co-operation with said chamber. This way it is possible to achieve a hydraulic regulation of the position of the impulse piston.

Figure 2:
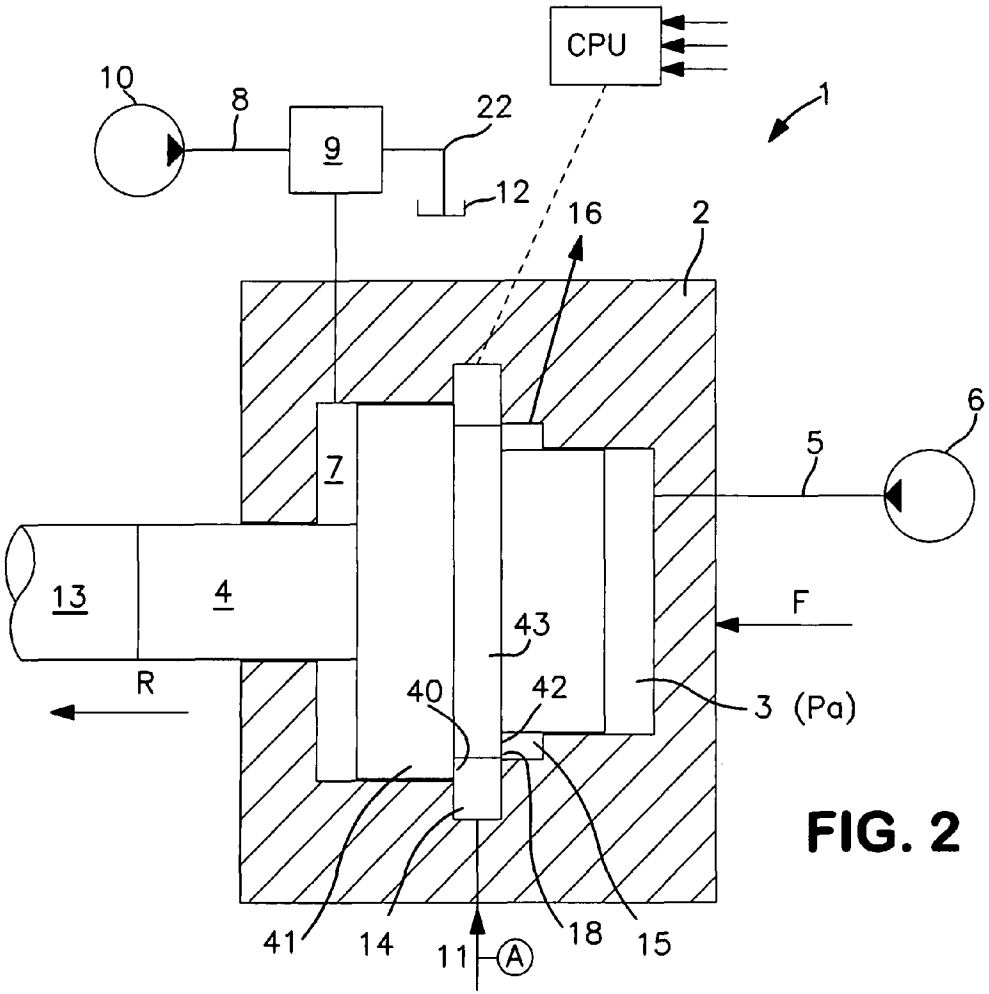

In the alternative embodiment in FIG. 2, like and corresponding elements are given the same reference numerals as in FIG. 1. The embodiment shown in FIG. 2 differs from the one in FIG. 1 by the second damping channel 16 being connected to the second fluid chamber 15. An accumulator A is connected to the channel 11.

In both embodiments and described variants according to the FIGS. 1 and 2, the flow through the first fluid chamber/chambers can be utilized for cooling heat generated during damping.

Figure 3:
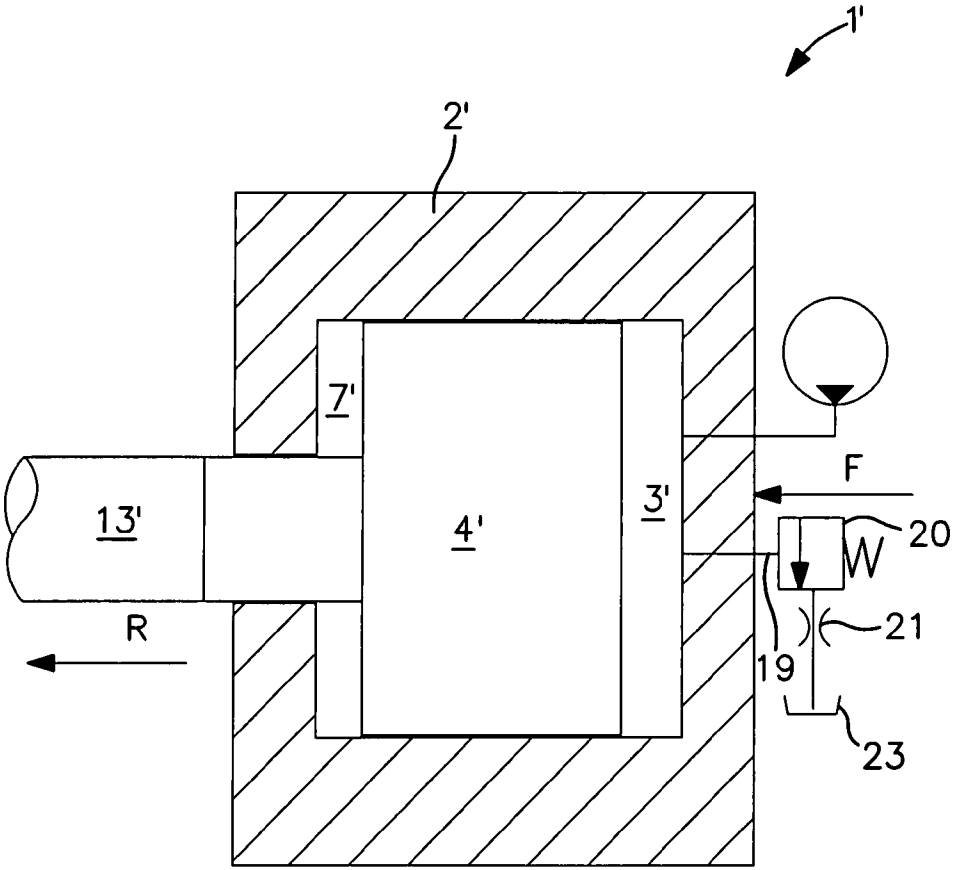
FIG. 3 shows a further embodiment of a pulse machine according to the invention in an axial section.

In the alternative embodiment of an impulse generator 1' in FIG. 3 is utilized the pressurising chamber 3' as first fluid chamber for the system. The first fluid chamber is thus connected to a high pressure fluid source HP, either permanently or intermittent depending on which type of impulse generator that is present.

This results in that no separate fluid or damping chamber needs to be arranged in connection with the impulse piston 4', but that instead to the pressurizing chamber 3' is connected a fluid flow channel in the form of a damping channel 19 which over, for example, a pressure reduction valve 20 at a certain pressure in the pressurizing channel exceeding a certain determine pressure allows a flow through a restriction 21 for obtaining damping and energy absorption. As alternative or supplement, downstream of the pressure reduction valve, there can be inserted an accumulator (not shown) for providing a desired damping force.

All restrictions in the damping channels in FIGS. 1, 2 and 3 can be adjustable for controlling the damping.

The invention has been described at the background of shock wave pulses being generated by a counter force pressure in a counter acting chamber being abruptly relieved. It should be stressed that the invention is also applicable in respect of pulse drilling machines, wherein shock wave pulses are instead generated by abruptly increasing another fluid pressure, which is the pressure in the pressurizing chamber. Means for generating shock wave pulses in these different manners are, however, per see previously known and do therefore not need to be discussed further here.

Figure 4:
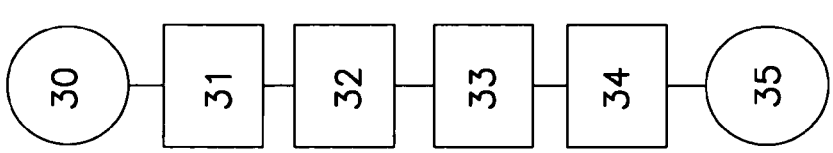
FIG. 4 shows a block diagram over a method according to an embodiment of the invention.

An example of a method sequence according to the invention is diagrammatically illustrated in FIG. 4, wherein:

Position 30 indicates the start of the sequence and pressurizing of the pressurizing chamber 3, Position 31 indicates initially applying a feed force F to the machine.

Position 32 indicates switching of a valve for pressurizing the counter force chamber 7.

Position 33 indicates abrupt relief of the fluid pressure in the counter force chamber 7 acting on the impulse piston for generating a shock wave pulse.

Position 34 indicates that the CPU detects the pressure in the first fluid chamber 14 in order to, therefrom, determine the magnitude and character of the rock reflexes and therefrom control a machine parameter such as for example the pulse frequency, the feed force, the throttling, the damping flow, the damping pressure, the process of relieving the pressure in the counter acting chamber and, at occurrences, the build-up of the pressure in the pressurizing chamber in order to control the drilling in the direction of enhanced efficiency or any other drilling criterion.

The sequence thereafter returns to position 32 or to position 35 which indicates end of the sequence.

CPU in FIG. 1 has the capacity to regulate the machine such that in a new impulse cycle, a shock wave will be induced which has a different length or shape than the previous shock wave. As an example, the feed force is regulated for changing the distance which the impulse piston is pushed into the housing. CPU can also be arranged to control the frequency of the valve and opening and closing characteristics in order to influence the shock wave. Concerning the regulation, to the input interface of the CPU (indicated with 3 arrows) input signals concerning a plurality of parameters such as size and/or character of reflected shock wave, energy delivered to the machine, the amount of worked rock etc can be supplied. CPU can thereafter control the impulse generating process of the machine in the direction of for example enhanced efficiency.

The invention can be modified within the scope of the patent claims. The pulse length can, as is indicated above, be controlled by regulating of one of a plurality of control parameters effecting pulse generation, i.a. feed force, whereby a low feed force results in a short movement opposite to the tool direction and a short pulse length, whereas a high feed force gives a long movement opposite to the tool direction and long pulse length. Also variation of the pressure in the different chambers or alternatively duration of a pulse cycle respectively the portion of the pulse cycle when pressing-in occurs, can contribute in this connection. Means for regulating the feed force can be the usual according to the prior art, feed means acting on an impact tool, modified in order to allow control of the size of the applied force.

Rock characteristic which can be read from sensed shock wave reflexes can be utilized respectively considered for controlling the length of the shock wave pulse.

Another way of regulating is to control shock wave characteristics such as in particular shock wave length starting out from a chosen lowest efficiency or alternatively a chosen lowest drilling rate in order to e.g. minimize energy supplied to the machine. The control can also be had in the direction of enhanced machine working life, wherein for example higher frequency and lower pulse energy can come into question. In case of control for enhanced production economy, all relevant involved systems are considered in total.

The pressing force can also be achieved through elastic means such as springs of metal, rubber etc., a metal rod etc. in the cases where the shock wave is generated through abrupt relief of a counter acting pressure. The amplitude, frequency as well as shape can be controlled according to the invention. Concerning the shape of the shock wave, for example the process of opening the valve 9 to tank can be controlled in order to control how the up-flank of the shock wave pulse is shaped. An abrupt opening gives in principle steep up-flank and a lengthier opening gives a more slanting up-flank. A more slanting up-flank can contribute to reduction of the rock reflexes but cause efficiency losses in the valve. Also the shape of the down-flank of the shock wave can be controlled by for example the movement pattern of the valve 9.

The valve 9 is preferably a per se known valve with rotational valve body which is provided with openings for obtaining its functions.

Control of the impulse frequency can be achieved by regulating in the rotational speed of the valve body. Many other types of valves 9 come into question, for example solenoid valves or so called spreader valves.

The valve 9 can be included in a control device including regulating means for regulating the process of the pressure reduction in the counter force chamber. This has the advantage that rising time of the shock wave and/or duration can be regulated based on the properties of the drilled material such that a greater part of the shock wave energy can be received by the drilled material with reduced reflexes as a result.

The means for pressure reduction can include a control valve for connection to the counter force chamber, whereby the control valve can include at least one opening for controlling said pressure reduction by relief of pressure medium contained inside the chamber under operation. The pressure reduction can be regulated by control of the opening process of the control valve. For example, the control valve can be constructed with pressure relief grooves for regulating the pressure reduction. This has the advantage that the process of the pressure reduction can be regulated in a simple way.

The different pressures that are transmitted to the counter force and pressurizing chambers of the impulse machine can be varied, either through control of the respective pump or through intermediate, not shown, pressure regulating valves. In a simple variant, there prevails a system pressure for a rig in both chambers. As a principle, higher pressure gives greater pulse amplitude of the pulse and, given the same pulse length, higher pulse energy.

The invention claimed is:

1. Pulse drilling machine for the generation of shock wave pulses in a tool direction (R) including a housing wherein an impulse piston is arranged, and including means for abruptly changing a fluid pressure influencing the impulse piston in order to achieve a force resultant on the impulse piston in the tool direction and thereby generate a shock wave pulse in a drill string which is connected to the machine, wherein inside the housing there is arranged a first fluid chamber inside which pressure fluid in operation is arranged to exert a pressure in the tool direction on the impulse piston, said pulse drilling machine including a fluid flow channel, which includes means for damping a fluid flow flowing from said first fluid chamber through the fluid flow channel obtained when influencing the impulse piston in a direction opposite to the tool direction (R) by rock reflexes in the drill string during drilling.

2. Pulse drilling machine according to claim 1, wherein the fluid flow channel includes a restriction.

3. Pulse drilling machine according to claim 1, wherein the fluid flow channel is connected to a pressure fluid accumulator (A).

4. Pulse drilling machine according to claim 1, wherein the first fluid chamber is a separate damping chamber, which is arranged radially outside the impulse piston.

5. Pulse drilling machine according to claim 4, wherein the fluid flow channel includes a throttling slit between the housing and the impulse piston for energy absorption.

6. Pulse drilling machine according to claim 5, wherein a supply channel for fluid is connected to the damping chamber for providing a cooling leak flow.

7. Pulse drilling machine according to claim 4, wherein a supply channel for fluid is connected to the damping chamber for providing a cooling leak flow.

8. Pulse drilling machine according to claim 1, wherein the first fluid chamber is a chamber adjoining axially to the impulse piston.

9. Pulse drilling machine according to claim 8, wherein the fluid flow channel includes a pressure reduction valve.

10. Pulse drilling machine according to claim 9, wherein the first fluid chamber is connected to a high pressure fluid source (HP).

11. Pulse drilling machine according to claim 9, wherein the first fluid chamber is permanently connected to a high pressure fluid source.

12. Pulse drilling machine according to claim 9, wherein the first fluid chamber is intermittently connected to a high pressure fluid source.

13. Pulse drilling machine according to claim 8, wherein the first fluid chamber is connected to a high pressure fluid source (HP).

14. Pulse drilling machine according to claim 13, wherein the first fluid chamber is permanently connected to the high pressure fluid source.

15. Pulse drilling machine according to claim 13, wherein the first fluid chamber is intermittently connected to the high pressure fluid source.

16. Pulse drilling machine according to claim 8, wherein the first fluid chamber is permanently connected to a high pressure fluid source.

17. Pulse drilling machine according to claim 8, wherein the first fluid chamber is intermittently connected to a high pressure fluid source.

18. Pulse drilling machine according to claim 17, including means for regulating the frequency for the generation of the shock wave pulses.

19. Pulse drilling machine according to claim 1, including means for sensing the pressure in the first fluid chamber.

20. Pulse drilling machine according to claim 19, wherein said means for abruptly changing the fluid pressure influencing the impulse piston are controllable starting out from sensed pressure in the first fluid chamber in order to allow control of the generated shock wave pulse.

21. Pulse drilling machine according to claim 1, including means for regulating the fluid flow in the fluid flow channel and thereby the damping.

22. Pulse drilling machine according to claim 21, wherein a controllable restriction is arranged.

23. Pulse drilling machine according to claim 1, wherein said impulse piston provides a damping function.

24. Rock drilling rig including a pulse drilling machine according to claim 1.

25. Method in a pulse drilling machine for the generation of shock wave pulses in a tool direction (R), including a housing wherein an impulse piston is arranged, wherein an abrupt change of a fluid pressure influencing the impulse piston causes a force resultant on the impulse piston in the tool direction and thereby the generation of a shock wave pulse in a drill string connected to the machine, wherein inside the housing is arranged a first fluid chamber inside which pressure fluid in operation exerts a pressure in the tool direction on the impulse piston, said method including the step of a fluid flow flowing through a fluid flow channel being connected to the first fluid chamber obtained when influencing the impulse piston in a direction opposite to the tool direction by rock reflexes in the drill string during drilling is damped.

26. Method according to claim 25, wherein the fluid flow is throttled.

27. Method according to claim 26, wherein the fluid flow is lead to a pressure fluid accumulator (A).

28. Method according to claim 25, wherein the fluid flow is lead to a pressure fluid accumulator (A).

29. Method according to claim 25, wherein a cooling leak flow is provided.

30. Method according to claim 25, wherein the fluid flow is lead over a pressure reduction valve.

31. Method according to claim 25, wherein the first fluid chamber is connected to a high pressure fluid source (HP).

32. Method according to claim 25, wherein the pressure in the first fluid chamber is detected.

33. Method according to claim 32, wherein said abrupt change of the fluid pressure influencing the impulse piston is regulated starting out from said pressure in the first fluid chamber for controlling the generated shock wave pulse.

34. Method according to claim 25, wherein the frequency for generating the shock wave pulses is regulated.

35. Method according to claim 25, wherein the fluid flow in the fluid flow channel and thereby the damping is regulated.

36. Method according to claim 25, wherein said impulse piston provides a damping function.

* * * * *